US005841240A

United States Patent [19]

Beij et al.

[11] Patent Number: 5,841,240

[45] Date of Patent: Nov. 24, 1998

[54] EFFICIENT DISCHARGE LAMP ELECTRODE HEATING CIRCUIT OPERABLE OVER WIDE TEMPERATURE AND POWER RANGE

[75] Inventors: Marcel Beij, Eindhoven; Hendrikus J. W. Schenkelaars, Oss; Arnold W. Buij, Eindhoven, all of Netherlands

[73] Assignee: U.S. Philips Corporation, New York, N.Y.

[21] Appl. No.: 733,993

[22] Filed: Oct. 18, 1996

[30] Foreign Application Priority Data

Oct. 20, 1995 [BE] Belgium ..... 09500874

[51] Int. Cl.[6] ..... H05B 37/02

[52] U.S. Cl. ..... 315/219; 315/225; 315/100; 315/107; 315/214

[58] Field of Search ..... 315/224, 209 R, 315/106, 107, 205, 225, 276, 278, 105, 219, 100, 214

[56] References Cited

U.S. PATENT DOCUMENTS 5,027,033 6/1991 Zuchtriegel ..... 315/106

5,406,174 4/1995 Slegers ..... 315/219

5,619,105 4/1997 Holmquest ..... 315/225

*Primary Examiner*—Arnold Kinkead

*Attorney, Agent, or Firm*—Edward Blocker

[57] ABSTRACT

A circuit arrangement for operating a discharge lamp comprising input terminals for connection to a supply voltage source. A load branch B has terminals for holding the discharge lamp and includes an inductive ballast. A device I is coupled to ends of the load branch and to the input terminals to generate a high-frequency voltage from the supply voltage furnished by the supply voltage source. A device II is coupled to the device I to adjust the power consumed by the discharge lamp, the frequency of the high-frequency voltage being dependent upon the adjusted value of the power consumption. A transformer having a primary winding and secondary windings with each secondary winding shunted by an electrode branch during lamp operation, which electrode branch includes an electrode of the discharge lamp. The primary winding forms part of a branch C which also includes a frequency-dependent impedance and which shunts the load branch. Thus, a desired relationship exists between the heating currents through the electrodes and the discharge current over a wide range of power consumed by the discharge lamp.

20 Claims, 2 Drawing Sheets

EFFICIENT DISCHARGE LAMP ELECTRODE HEATING CIRCUIT OPERABLE OVER WIDE TEMPERATURE AND POWER RANGE

BACKGROUND OF THE INVENTION

This invention relates to a circuit arrangement for operating a discharge lamp, comprising:

input terminals for connection to a supply voltage source, a load branch B provided with terminals for holding the discharge lamp and with inductive ballast means, means I coupled to ends of the load branch B and the input terminals to generate a high-frequency voltage from the supply voltage furnished by the supply voltage source, means II coupled to the means I to adjust the power consumed by the discharge lamp, the frequency of the high-frequency voltage being dependent upon the adjusted value of the power consumption, and a transformer having a primary winding and secondary windings, each secondary winding being shunted by an electrode branch during lamp operation, which electrode branch includes an electrode of the discharge lamp.

Such a circuit arrangement is known from U.S. Pat. No. 5,406,174. In the known circuit arrangement the primary winding forms part of the inductive ballast means. The power consumed by the discharge lamp is adjusted by adjusting the frequency of the high-frequency voltage. At increasing frequency the impedance of the inductive ballast means increases, as a result of which the current through the discharge lamp and the power consumed by the discharge lamp decrease. Moreover, the voltage across the primary winding of the transformer increases, so that the voltage across the secondary windings also increases. As a result, the heating currents flowing through the electrodes of the discharge lamp increase so that over a wide range of power consumption of the discharge lamp the electrodes are kept at a temperature at which an efficient electron emission takes place. A great disadvantage of the known circuit arrangement is that the voltage across the primary winding of the transformer is influenced to a significant degree by the voltage across the discharge lamp. The voltage across the discharge lamp depends strongly on the ambient temperature, so that a change in ambient temperature may result in too large or too small a heating current through the electrodes of the discharge lamp. A second lamp property of, particularly, low-pressure mercury discharge lamps which may affect the desired relationship between discharge current and heating current is that upon a decrease in the amount of power consumed by the discharge lamp the voltage across the discharge lamp initially increases but subsequently decreases.

SUMMARY OF THE INVENTION

It is an object of the invention to provide a circuit arrangement by means of which, during operation of the lamp an efficient electrode heating is achieved over a comparatively wide range of power consumed by the discharge lamp and over a comparatively wide ambient temperature range.

To this end, according to the invention, a circuit arrangement as defined in the opening paragraph is characterized in that the primary winding forms part of a branch C which also includes a frequency-dependent impedance and which shunts the load branch.

Since the primary winding and the discharge lamp have been arranged in different branches the voltage across the primary winding is not influenced by the voltage across the discharge lamp and consequently depends on the ambient temperature to a comparatively small degree only. Since upon a change of the power consumed by the discharge lamp the frequency of the high-frequency voltage also changes while its amplitude remains substantially constant, the voltage across the frequency-dependent impedance changes likewise. As a result, the voltage across the primary winding and, as a consequence, the heating current also change. It has been found that a circuit arrangement in accordance with the invention enables an effective electrode heating to be achieved, even in the case where the power consumed by the discharge lamp is set to a very small value.

Preferably, the frequency-dependent impedance comprises a capacitor. This is a simple and also cheap manner of realizing the frequency-dependent impedance.

In the case where the branch C further includes an ohmic impedance, further control of the relationship between discharge current and heating current is possible by an appropriate choice of this ohmic impedance. This ohmic impedance limits the amplitude of the current in the branch C. In the case that it is desirable to limit the current through the branch C also if one or both electrodes of the discharge lamp are short-circuited, the ohmic impedance preferably comprises a temperature-dependent resistor of the PTC type. If as a result of a short-circuit of one or both electrodes the current through the temperature-dependent resistor of the PTC type increases, the temperature and the resistance value of the temperature-dependent resistor increase likewise through power dissipation. This increased resistance value ensures that the current through the branch remains limited even in the case of short-circuited electrodes. A problem of the use of which a temperature-dependent resistor of the PTC type for the present purpose is that the temperature-dependent resistor generally has a comparatively high parasitic capacitance. Since the current flowing through the branch C during operation of the circuit arrangement is a high-frequency current, this parasitic capacitance constitutes only a comparatively small impedance for this current, even if the resistance of the temperature-dependent resistor is comparatively high. However, in the case where the branch C further comprises a diode bridge and the temperature-dependent resistor of the PTC type interconnects output terminals of the diode bridge, the high-frequency current is rectified by the diode bridge and a direct current flows in the temperature-dependent resistor during operation of the circuit arrangement. For this direct current the parasitic capacitance in principle forms an infinitely large impedance, so that the actual impedance of the temperature-dependent resistor is wholly determined by the ohmic resistance value. This enables an effective limitation of the current in the branch C in the case of one or more short-circuited electrodes despite the comparatively high parasitic capacitance of the temperature-dependent resistor.

Preferably, the means I for generating a high-frequency voltage comprise a branch A which includes a series arrangement of two switching elements, the load branch B shunting one of the switching elements. This is a comparatively simple and reliable manner of realizing the means I.

It is advantageous if the branch C and the electrode branches shunting the secondary windings L2 and L3 are so dimensioned that the phase difference between the current through the secondary windings L2 and L3 and the current through the discharge lamp decreases as the frequency of the high-frequency voltage increases. As a result of such a phase relationship the currents through the secondary windings provide a larger contribution to the development of heat in the electrodes as the power consumed by the discharge lamp decreases.

It is also advantageous if the branch C further includes a switching element for interrupting the current through the primary winding in the case where the discharge current exceeds a predetermined value. A discharge current larger than the predetermined value usually produces a power dissipation in the electrodes which is adequate to maintain the electrodes at a temperature at which an efficient electron emission takes place. Moreover, in the case of a comparatively large discharge current, depending on the dimensioning of the branch C and the electrode branches, the phase difference between the discharge current and the heating currents can be such that they partly compensate for one another and, in fact, a cooling of the electrode is accomplished. If the switching element is turned off at such a comparatively large discharge current, no heating current flows through the electrodes, which saves power. The switching element may, for example, be coupled to the means II. It is also conceivable, however, to couple the switching element to a further circuit section which, for example by means of a photocell, generates a signal which is a measure of the luminous flux of the discharge lamp and, hence, also of the discharge current.

BRIEF DESCRIPTION OF THE DRAWINGS

Embodiments of a circuit arrangement in accordance with the invention will be described in more detail with reference to the accompanying drawings. In the drawings.

FIG. shows diagrammatically an embodiment of a circuit arrangement in accordance with the invention with a discharge lamp connected thereto.

DESCRIPTION OF THE PREFERRED EMBODIMENTS

Figure 1:
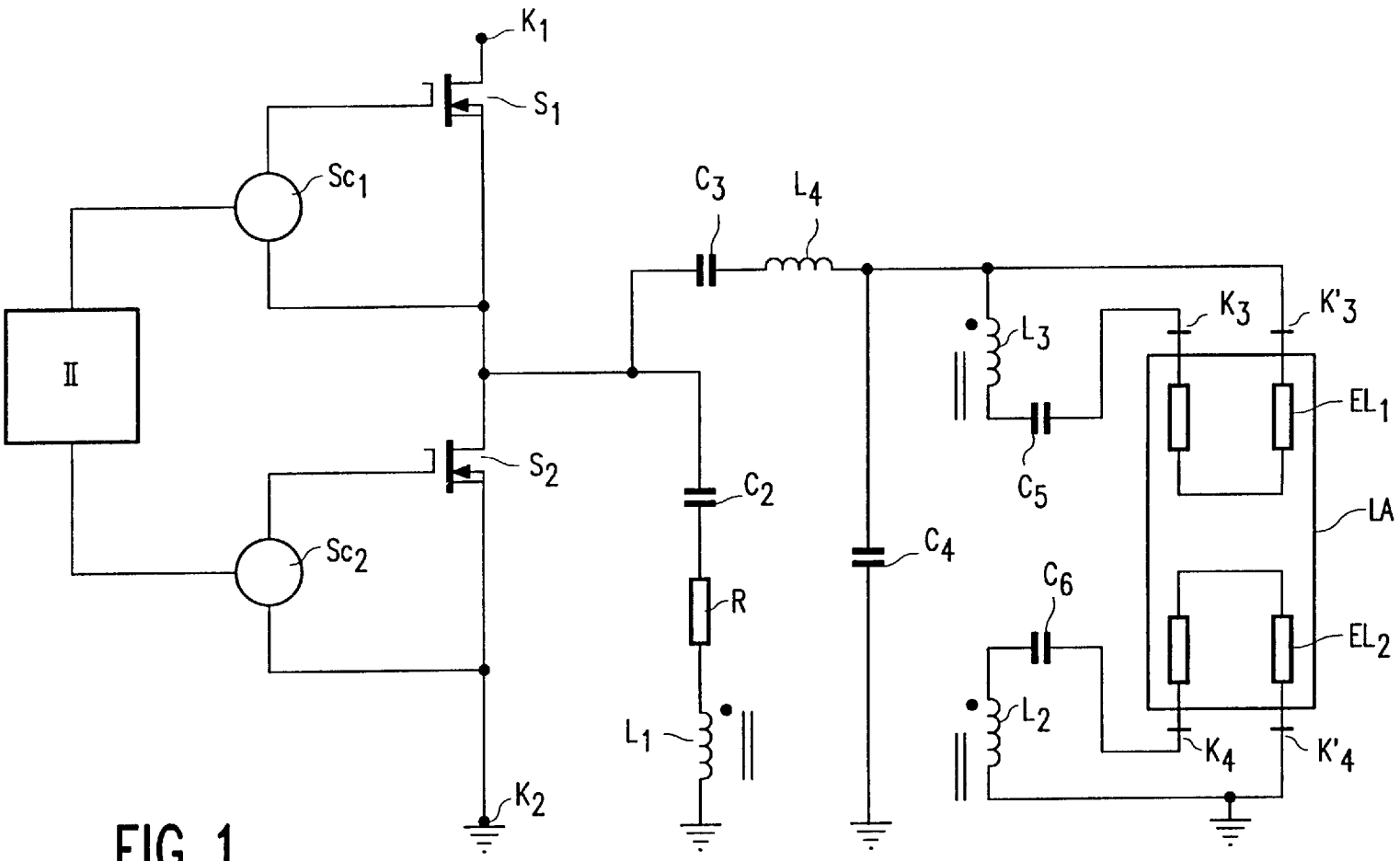

In FIG. 1, K1 and K2 are input terminals for connection to a supply voltage source. In the present embodiment the supply voltage source should be a direct voltage source. In this embodiment the load branch B includes capacitors C3 and C4, a coil L4 and terminals K3, K3', K4 and K4'for holding a discharge lamp. In the present embodiment the coil L4 forms an inductive ballast means. A discharge lamp LA having electrodes E11 and E12 is connected to the terminals K3, K3', K4 and K4'. L2 and L3 are secondary windings of a transformer T. The secondary winding L3 is shunted by an electrode branch formed by a series arrangement of the terminal K3', the electrode E11, the terminal K3 and a capacitor C5. The secondary winding L2 is shunted by an electrode branch formed by a series arrangement of the terminal K4, the electrode E12, the terminal K4' and the capacitor C6. The secondary windings L2 and L3 and the electrode branches shunting these secondary windings also form a part of the load branch B. A branch C is formed by a series arrangement of a capacitor C2, an ohmic resistance R and a primary winding L1 of the transformer T. In the present embodiment the capacitor C2 forms a frequency-dependent impedance. The switching elements S1 and S2 and control circuits Sc1 and Sc2 constitute the means I for generating a high-frequency voltage from a supply voltage furnished by the supply voltage source. A circuit section II forms means II for adjusting the power consumed by the discharge lamp.

The input terminal K1 is connected to the input terminal K2 via a series arrangement of the switching elements S1 and S2. The control circuit Sc1 has respective outputs connected to a control electrode and a main electrode of the switching element S1. The control circuit Sc2 has respective outputs connected to a control electrode and a main electrode of the switching element S2. One output of the circuit section II is connected to an input of the control circuit Sc1. A second output of the circuit section II is connected to an input of the control circuit Sc2. The switching element S2 is shunted by a branch C and by a series arrangement of the capacitor C3, the coil L4 and the capacitor C4, in such a manner that the capacitor C4 has one end connected to the input terminal K2. The terminal K3' is connected to a node common to the coil L4 and the capacitor C4. The terminal K4' is connected to the input terminal K2.

The operation of the circuit arrangement shown in FIG. 1 is as follows.

When a supply voltage source is connected to the input terminals K1 and K2 and the circuit arrangement is in operation, the control circuits Sc1 and Sc2 alternately turn on and turn off the switching elements S1 and S2. As a result, a high-frequency voltage appears between the ends of the branches B and C. This high-frequency voltage produces in each of the branches B and C a high-frequency alternating current having a frequency equal to the frequency of the high-frequency voltage. A portion of the high-frequency alternating current flowing in the branch B forms the discharge current through the discharge lamp LA. The high-frequency current in the branch C flows through the primary winding L1, as a result of which a high-frequency voltage appears both between the ends of the secondary winding L2 and between the ends of the secondary winding L3. These high-frequency voltages across the secondary windings produce high-frequency heating currents in the electrode branches shunting the secondary windings and, consequently, through the electrodes E11 and E12 of the discharge lamp LA. Both the discharge current and the heating current give rise to the development of heat in the electrodes E11 and E12, thereby maintaining these electrodes at a temperature suitable for electron emission. By means of the circuit section II it is possible to adjust the time interval during which each of the switching elements conducts in each high-frequency period and, hence, also the power consumed by the lamp. If the time interval during which each of the switching elements conducts is reduced the discharge current through the discharge lamp LA decreases. Moreover, the frequency of the high-frequency voltage increases while the amplitude of the high-frequency voltage remains unchanged. In the branch C this causes the voltage drop across the capacitor C2 to decrease and the voltage drop across the primary winding L1 to increase. As a result of the increase of the voltage drop across the primary winding L1 the heating currents through the electrodes E11 and E12 also increase. Thus, when the discharge lamp is dimmed the reduced heat development in the electrodes as a result of smaller discharge current is compensated at least partly by larger heating currents. However, the heat development in the electrodes is determined not only by the amplitudes of the discharge current and the heating current but also by their phase relationship. This phase relationship, as well as the relationship between the amplitudes of the discharge current and the heating currents, is a function of the high-frequency voltage. The form of this phase relationship as a function of the high-frequency voltage is determined by the components of the branch C and of the two branches shunting the secondary windings L2 and L3 and by their dimensioning. In the circuit arrangement shown in FIG. 1 the components and their dimensioning have been selected in such a manner that the discharge current and the heating currents are substantially in phase opposition for the largest adjustable discharge current (and, consequently, for the lowest value of the frequency of the high-frequency voltage). For the smallest adjustable value of the discharge current (and, consequently, for the highest value of the frequency of the high-frequency voltage), however, the heating current and the discharge current are substantially in phase. This phase relationship ensures that, in the case where the largest discharge current flows through electrodes of the discharge lamp LA, the heating current partly compensates for this discharge current, as a result of which the heat development in the electrodes is smaller than it would have been in the absence of the heating current. In the case that the largest adjustable discharge current flows in the discharge lamp the electrodes are, in fact, cooled. However, in the case where the discharge current through the electrodes of the discharge lamp LA is small the heating currents and the discharge current are substantially in phase, as a result of which the heating current and the discharge current in each electrode amplify one another and the heating current causes the heat developed in the electrodes to increase considerably. Owing to this phase relationship the heat developed in the electrodes can be controlled to a desired level over a comparatively wide range of power consumed by the discharge lamp.

Figure 2:
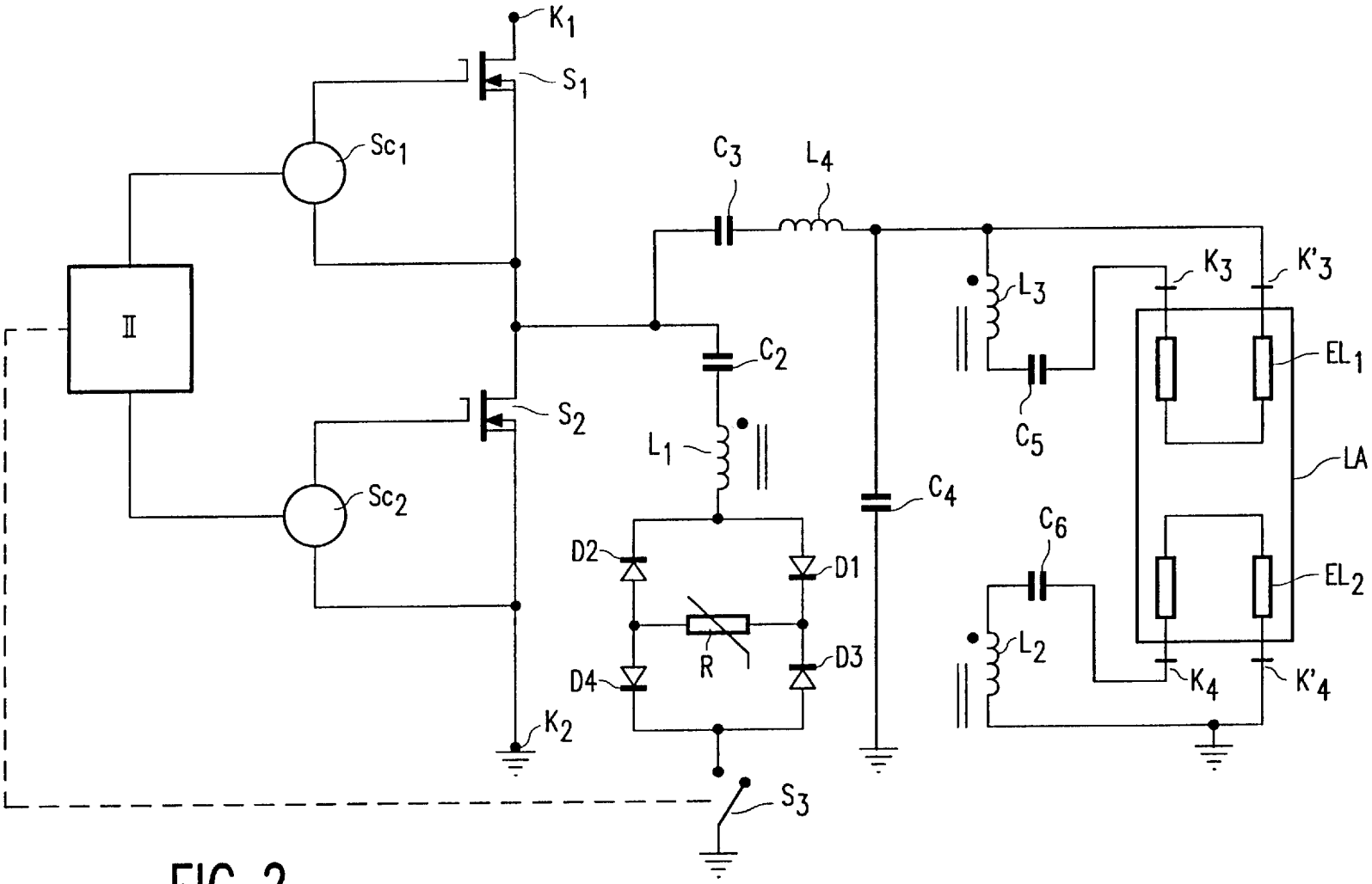
FIG. 2 shows diagrammatically a further embodiment of a circuit arrangement in accordance with the invention with a discharge lamp connected thereto.

In FIG. 2 circuit sections and components corresponding to circuit sections and components of the embodiment shown in FIG. 1 bear corresponding reference symbols. The embodiment shown in FIG. 2 differs only from the embodiment shown in FIG. 1 as regards the construction of the branch C. In the embodiment shown in FIG. 2 the branch C is formed by a capacitor C2, a primary winding L1, a diode bridge D1–D4, a temperature-dependent resistor R of the PTC type, and a switching element S3. The capacitor C2 has a first end connected to a node common to the switching element S1 and the switching element S2. The capacitor C2 has a second end connected to a first end of the primary winding L1. A second end of the primary winding L1 is connected to a first input of the diode bridge D1–D4. A first output of the diode bridge D1–D4 is connected to a second output of the diode bridge D1–D4 by means of a temperature-dependent resistor R of the PTC type. A second input of the diode bridge D1–D4 is connected to a first main electrode of the switching element S3. A second main electrode of the switching element S3 is connected to the input terminal K2. A control electrode of the switching element S3 is coupled to a third output of the circuit section II. In FIG. 2 this coupling is shown as a broken line.

The operation of the embodiment shown in FIG. 2 largely corresponds to the operation of the embodiment shown in FIG. 1. The embodiment shown in FIG. 2 in addition comprises a short-circuit protection and the possibility to turn off the electrode heating.

When the terminal K3 is connected directly to the terminal K3' and/or the terminal K4 is connected directly to the terminal K4' this results in a very large current in the electrode branch which shunts the secondary winding L3 and/or the electrode branch which shunts the secondary winding L2. This also results in a very large current in the branch C. The last-mentioned current produces power dissipation in the temperature-dependent resistor R, thereby causing a rise in its temperature. As a result of this temperature rise the resistance of the temperature-dependent resistor R increases substantially, thereby causing the current in the branch C to decrease. This provides an effective protection of circuit arrangement against a short-circuit of one or more electrodes.

If the discharge current exceeds a predetermined value the circuit section II turns off the switching element S3. As a result, the electrode heating current is reduced to substantially zero, thus enabling power to be saved at comparatively large values of the discharge current. The discharge current at these comparatively large values is adequate to maintain the electrodes of the discharge lamp at a suitable emission temperature.

In a practical implementation of the embodiment shown in FIG. 1 the branch C and the electrode branches of a circuit arrangement in accordance with the invention were dimensioned as follows for the operation of a low-pressure mercury discharge lamp having a power rating of 58 W. The electrodes of the low-pressure mercury discharge lamp are, in a first approximation, ohmic resistances having a resistance (in heated condition) of approximately 5.6 Ω. The capacitance of C5 and C6 was 470 nF. The capacitance of the capacitor C2 was 680 pF. The ohmic resistance R was formed by the ohmic resistance of the primary winding and the resistance value was 200 Ω. The leakage inductance of the transformer T was approximately 1.35 mH. It was found to be possible to reduce the discharge power consumed by the discharge lamp to only 1 percent of the power rating of the discharge lamp, the heat developed in the electrodes being such that the electrodes are at a suitable temperature for electron emission throughout the entire range of power consumed by the lamp.

We claim:

1. A circuit arrangement for operating a discharge lamp, comprising:

input terminals for connection to a supply voltage source, a load branch provided with terminals for holding the discharge lamp and with inductive ballast means, means coupled to ends of the load branch and to the input terminals for generating a high-frequency voltage from the supply voltage furnished by the supply voltage source, further means coupled to the generating means for adjusting the power consumed by the discharge lamp, the frequency of the high-frequency voltage being dependent upon the adjusted value of the power consumption, a transformer having a primary winding and secondary windings, each secondary winding being shunted by an electrode branch during lamp operation, which electrode branch includes an electrode of the discharge lamp, and the primary winding forms a part of a circuit branch which also includes a frequency-dependent impedance and which circuit branch permanently shunts the load branch whereby the primary winding is not influenced by the voltage across the discharge lamp.

2. A circuit arrangement as claimed in claim 1, wherein the frequency-dependent impedance comprises a capacitor.

3. A circuit arrangement as claimed in claim 1, wherein the circuit branch further includes an ohmic impedance.

4. A circuit arrangement as claimed in claim 3, wherein the ohmic impedance comprises a temperature-dependent resistor of the PTC type.

5. A circuit arrangement as claimed in claim 4, wherein the circuit branch further comprises a diode bridge and the temperature-dependent resistor of the PTC type interconnects output terminals of the diode bridge.

6. A circuit arrangement as claimed in claim 1, wherein the high-frequency voltage generating means comprise a further branch which includes a series arrangement of two switching elements, and the load branch shunts one of the switching elements.

7. A circuit arrangement as claimed in claim 1, wherein the circuit branch and the electrode branches shunting the secondary windings are dimensioned so that a phase difference between the current through the secondary windings and the current through the discharge lamp decreases as the frequency of the high-frequency voltage increases.

8. A circuit arrangement as claimed in claim 1, wherein the circuit branch further includes a switching element for interrupting the current through the primary winding if the discharge current exceeds a predetermined value.

9. The circuit arrangement as claimed in claim 1 wherein the circuit branch includes a PTC resistor and the circuit branch and the electrode branches shunting the secondary windings are dimensioned so that a phase difference between the current through the secondary windings and the current through the discharge lamp decreases as the frequency of the high-frequency voltage increases.

10. The circuit arrangement as claimed in claim 7 wherein the circuit branch further includes a switching element for interrupting the current through the primary winding if the discharge current exceeds a predetermined value.

11. A circuit for operating a discharge lamp comprising:

input terminals for connection to a source of supply voltage for the circuit, a load circuit including means for connection to the discharge lamp, means coupled to the input terminals and to the load circuit for generating a high-frequency voltage for the load circuit, an inductive ballast coupling said high-frequency voltage generating means to the load circuit, means coupled to the high-frequency voltage generating means for adjusting the lamp power as a function of the frequency of the generated high-frequency voltage, a transformer having a primary winding and first and second secondary windings with each secondary winding coupled to respective first and second lamp electrode branches during lamp operation, and a circuit branch permanently coupled in parallel with the load circuit and including the transformer primary winding and a frequency-dependent impedance whereby the transformer primary winding is not influenced by the voltage across the discharge lamp.

12. The lamp operating circuit as claimed in claim 11 wherein the circuit branch further comprises a PTC resistor connected in series circuit with the primary winding and the frequency-dependent impedance.

13. The lamp operating circuit as claimed in claim 11 wherein elements of the circuit branch and each lamp electrode branch are chosen so that a phase difference between current through the secondary windings and current through the discharge lamp decreases as the frequency of the high-frequency voltage increases.

14. The lamp operating circuit as claimed in claim 11 wherein the circuit branch further comprises a controlled switching element in series with the primary winding for interrupting current through the primary winding when the lamp discharge current exceeds a predetermined level.

15. The lamp operating circuit as claimed in claim 11 wherein the high-frequency voltage generating means comprises first and second controlled semiconductor switching elements connected in series circuit to the input terminals, said inductive ballast and the load circuit are connected in a further series circuit in parallel with one of said controlled semiconductor switching elements, and the primary winding and the frequency-dependent impedance are connected in a still further series circuit in parallel with said one of said controlled semiconductor switching elements.

16. The lamp operating circuit as claimed in claim 15 wherein said lamp power adjusting means is coupled to respective control electrodes of the first and second controlled semiconductor switching elements to alternately switch same on and off at a frequency determined by the desired operating power of the discharge lamp.

17. The lamp operating circuit as claimed in claim 11 wherein each electrode branch includes a respective capacitor and the frequency-dependent impedance comprises a further capacitor.

18. The lamp operating circuit as claimed in claim 11 wherein the circuit branch further comprises a controlled switching element connected in series with the transformer primary winding and the frequency-dependent impedance so as to interpret a current through the primary winding if the lamp discharge current exceeds a given level.

19. The lamp operating circuit as claimed in claim 11 wherein the circuit branch further comprises a resistor connected in series circuit with the primary winding and the frequency-dependent impedance, and the frequency-dependent impedance comprises a capacitor.

20. The lamp operating circuit as claimed in claim 11 wherein elements of the first and second lamp electrode branches and the circuit branch are chosen so that lamp discharge current and electrode heating currents are substantially in phase opposition for the highest adjusted discharge current, that is the lowest frequency value of the high-frequency voltage.

* * * * *